United States Patent [19]

Sakamoto

[11] Patent Number: 4,680,955

[45] Date of Patent: Jul. 21, 1987

[54] DIE EXCHANGE DEVICE

[75] Inventor: Katsuyoshi Sakamoto, Isehara, Japan

[73] Assignee: Amada Company, Limited, Japan

[21] Appl. No.: 720,014

[22] Filed: Apr. 4, 1985

[30] Foreign Application Priority Data

Apr. 7, 1984 [JP] Japan ..... 59-51091[U]
Apr. 9, 1984 [JP] Japan ..... 59-69189

[51] Int. Cl.[4] ..... B21J 13/08

[52] U.S. Cl. ..... 72/462; 72/478; 72/446; 72/481; 72/389; 100/918; 29/568

[58] Field of Search ..... 72/446, 448, 383, 481, 72/478, 479, 462, 389; 29/568; 100/918

[56] References Cited

U.S. PATENT DOCUMENTS 3,789,473 2/1974 Pagella et al. ..... 29/568
3,823,466 7/1974 Jerve ..... 29/568
4,110,987 9/1978 Hipwell et al. ..... 29/568
4,190,947 3/1980 Sato et al. ..... 29/568
4,312,111 1/1982 Peiser et al. ..... 29/568

FOREIGN PATENT DOCUMENTS 171235 10/1983 Japan ..... 29/568
274970 8/1976 U.S.S.R. ..... 29/568

*Primary Examiner*—Robert L. Spruill
*Assistant Examiner*—David B. Jones
*Attorney, Agent, or Firm*—Wigman & Cohen

[57] ABSTRACT

The present invention relates to a device for replacing upper and lower dies in a bending processing machine, such as, for example a press brake. According to the invention, long upper and lower dies used in a bending processing machine are comprised of freely dividable sections that can be taken apart and recombined for convenient storage in an adjacent die exchange device. In the die exchange device, die holders are formed on the insides of a number of link members which are pivotably linked in a loop.

6 Claims, 9 Drawing Figures

DIE EXCHANGE DEVICE

BACKGROUND OF THE INVENTION

1. Field of the Invention

This invention relates to a method and device for replacing upper and lower dies in a bending processing machine, such as, for example, a press brake. More specifically, it relates to a exchange method and device in which a long die in the bending processing machine is separated into a number of parts.

2. Description of the Prior Art

Previously, dies used in a bending processing machine such as a press brake have been replaced by simply transporting them in and out by means of a die exchange device on one side of the bending processing machine. Consequently, the die exchange device must have sufficient width to hold a very long die and takes up as much space as the bending processing machine, itself. That is to say, previously die exchange devices have been large and occupied a large area.

In addition, in general a rack device is used as the exchange device which holds and supports metal dies in a bending processing machine. However, to automate the exchange of dies in a bending processing machine, a device has been developed in which a number of link members are pivotally linked in an endless configuration and several link members form a die holder which holds the die. In such a configuration, it is necessary for the link members to be guided by a rigid guide rail to avoid problems when supporting a heavy die.

Existing die exchange devices having the configuration described above have separate sets of link members to hold upper dies and lower dies. This means that separate metal die insertion and removal transport devices are needed for the upper dies and lower dies. Consequently, existing die exchange devices have a number of problems such as that their construction is complicated and transport is difficult.

In addition, since the dies used in bending processing machines are long and very heavy, when the dies are supported by link members that are pivotally linked in a loop, there are problems such as that looseness occurs.

In an existing device in which the metal holders which hold the die are linked in a loop, the die holders are formed on the outsides of linked members which are linked in a loop. Consequently, the center of gravity is toward the outside, so that when the link members which are linked in a loop with dies in the die holders and when they move from the straight line to the circular arc section of the guide rail, speed increases and inertia becomes large, so that excessive load is placed on the motor and indexing of the dies becomes difficult.

SUMMARY OF THE INVENTION

The first purpose of this invention is to provide a die exchange method and device in which a long die which is used in a bending processing machine will be automatically divided into parts.

The second purpose of this invention is to provide a die exchange device that is short compared to the long upper and lower dies that are used in a bending processing machine.

The third purpose of this invention is to provide a die exchange device in which the upper and lower dies used in a bending processing machine can be replaced by a single insertion and removal transport device either simultaneously or separately.

The fourth purpose of this invention is reduce the force that acts in the tangential direction when die holders are circulating and move from the straight line section to the circular arc section of the guide rail.

In order to achieve the objectives described above, in this invention the long upper and lower dies used in a bending processing machine can be freely divided into sections and recombined so that the sections can be easily contained in the die holders. In addition, the upper and lower dies can be replaced either simultaneously or separately by a single die exchange device, and the die holders are formed on the insides of a number of link members which are pivotally linked in a loop.

DESCRIPTION OF THE PREFERRED EMBODIMENT

Figure 1:
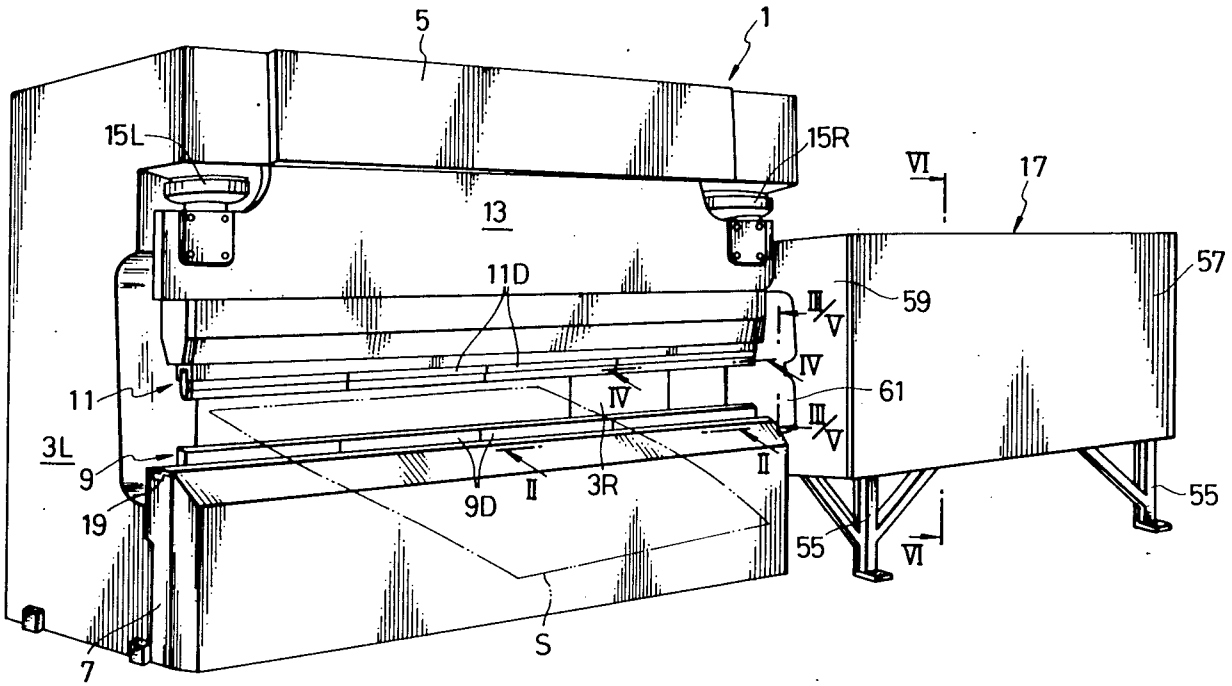
FIG. 1 is a perspective view which shows the relation between the bending processing machine and the die exchange device.

Referring to FIG. 1, a bending processing machine such as a press brake is denoted by 1. Like a regular press brake, it has left and right C-shaped side frames 3L and 3R. The top frame 5 is coupled solidly to the tops of the left and right side frames 3L and 3R, and the bottom frame 7 is attached to the bottoms of the side frames 3L and 3R. A long lower die 9 is attached to the top of the bottom frame 7 so that it can be freely attached and removed. Above the bottom frame 7 is a ram 13 which can move up and down freely and which supports an upper die 11 which, together with the lower die 9, performs bending processing of a plate S. The ram 13 is coupled to piston rods, which are free to move up and down, in hydraulic cylinders 15L and 15R, which in turn are supported by the side frames 3L and 3R, and is moved up. The ram 13 down by the action of the hydraulic cylinders 15L and 15R.

In order to attach, remove and replace the lower die 9 and upper die 11 in the bending processing machine 1, the lower die 9 and the upper die 11 can be moved in the longitudinal direction with respect to the bottom frame 7 and the ram 13, and can be attached and removed. In addition, to either side of the bending processing machine 1 is a die exchange device 17 which attaches, removes and replaces the lower die 9 and upper die 11 in the bending processing machine 1. As will be explained in more detail below, the die exchange device 17 has a number of die holders which can hold lower dies 9 and upper dies 11, and a die insertion and removal transport device which can push and pull lower dies 9 and upper dies 11 in the longitudinal direction.

Even though the die exchange device 17 holds the long lower die 9 and upper die 11 used in the bending processing machine 1, its width in the left-right direction is considerably less than, perhaps ½ or ⅓ of, the left-right width of the bending processing machine 1. Consequently, the die exchange device 17 is relatively small compared to the bending processing machine 11, making for efficient use of factory floor space. The efficiency is achieved because the die exchange device 17 divides the long lower die 9 and upper die 11 into a number of sections which it can hold.

Figure 2:
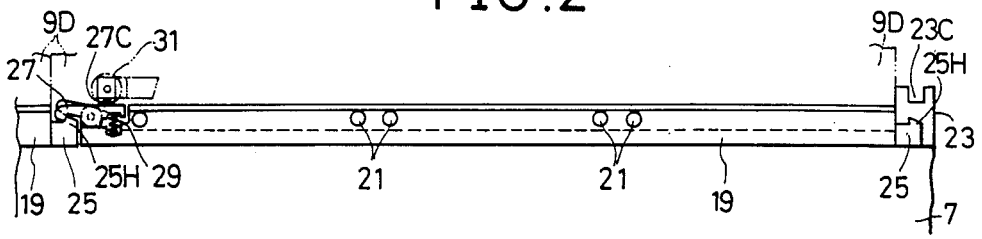
FIG. 2 is a detailed view along the cross-section II—II in FIG. 1.
Figure 3:
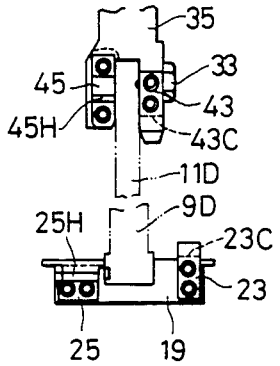
FIG. 3 is a side view seen from the direction of III/-V—III/V in FIG. 1.

As is already understood from the above discussion, the lower die 9 and the upper die 11, as shown in FIG. 1, are divided, respectively, into a number of lower die sections 9D and upper die sections 11D. More specifically, as is clearly shown in FIGS. 2 and 3, the lower die sections 9D can be attached to or removed from the lower die holders 19 through mounting screws 21. The lower die holders 19 are supported on top of the bottom frame 7 so that they can move in the longitudinal direction. At either end of these lower die holders 19 a hook block 23, which has a concave section 23C is attached. Lower latch levers, which are on the die insertion and removal transport device (to be described below) inside the die exchange device 17, can be attached and removed. Also a crow block 25, which has a hook 25H, is attached. In addition, at the other end of the lower die holders 19 a hook-shaped latch member 27 which can hook onto the crow block 25 on the neighboring lower die holder is pivotably mounted. The latch member 27 is biased in the counterclockwise direction in FIG. 2 by the action of a spring 29 which is between the latch member 27 and the lower holder 19. A cam 27C is formed as a protrusion on the upper surface of the latch member 27. This cam 27C is positioned to be engaged with a release roller 31 (shown conceptually by a line in FIG. 2, with details omitted) near one end of the die exchange device 17.

As can be understood from the above description of the configuration, when the lower die holders 19 which support the lower die sections 9D are pushed to the left, the latch member 27 at one end of a lower die section 9D is automatically hooked on the crow block 25 on the neighboring lower die holder 19. Conversely, when the lower die holder 19 is pulled to the right in FIG. 2, the latch member 27, which is hooked onto the crow block 25 of the neighboring lower die holder 19, moves together with the neighboring lower die holder 19; when the cam 27C on the latch member 27 contacts the release roller 31 near one end of the bottom frame 7, the latch member 27 is rotated clockwise (in FIG. 2) by the resistance of the spring 29 and released from the crow block 25. That is to say, the hooking of the latch member 27 to and its release from the crow block 25 on the neighboring lower holder 19 are performed automatically by moving lower holders 19 in the longitudinal direction along the bottom frame 7 on which the lower die 9 is to be replaced.

Figure 5:
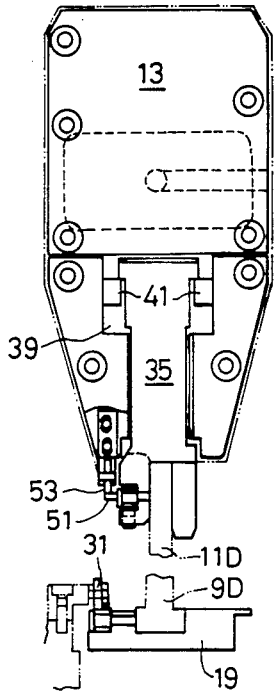
FIG. 5 is a side view seen from the direction of III/-V—III/V in FIG. 1.
Figure 4:
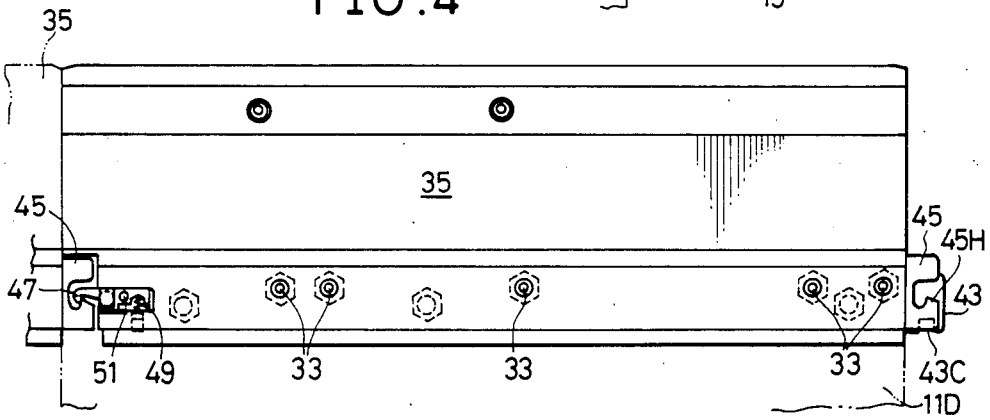
FIG. 4 is a front view of the cross-section IV—IV in FIG. 1.

As is shown in detail in FIGS. 4 and 5, the upper die sections llD are connected to the upper die holders 35 through the ball plungers 33. As is shown in FIG. 5, each upper die holder 35 is approximately T-shaped and can be attached to and removed from the die support section 39, in the form of a T-shaped groove, running in the logitudinal direction at the bottom of the ram 13. That is to say each upper die holder 35 is supported on a support roller 41, a number of which are supported inside the die support section 39 of the ram 13 so that they are free to rotate, so that it is free to move.

As can be clearly seen in FIG. 4, at one end of the upper die holder 35 is solidly attached a hook block 43, having a concave section 43C to which an upper die latch lever can be freely attached and removed. The upper die latch lever is provided with the die insertion and removal transport device in the die exchange device 17 to be described below. A crow block 45 with a hook 45H is also attached. A latch member 47 is forced in the counterclockwise direction (in FIG. 4) by the action of a spring 49 which is inserted between the latch member 47 and the upper die holder 35. The release pin 51 protrudes horizontally from the latch member 47. This release pin 51 is positioned to be attached to and removed from the release roller 53 (refer to FIG. 5) near the end of the ram 13 toward the die exchange device 17.

As can be understood from the above description of the configuration, when an upper die holder 35 is pushed toward the left in FIG. 4, the latch member 47 automatically hooks onto the crow block 45 on the neighboring upper die holder 35. Conversely, when an upper die holder is pulled to the right in FIG. 4, the latch member 47, hooked onto the crow block 45 of the neighboring upper die holder 35, moves together in a group with the neighboring upper die holder 35. When the release pin 51 on the latch member 47 contacts the release roller 53, the latch member 47 is rotated in the clockwise direction in FIG. 4 by the action of the spring 49 and is released from the crow block 45. That is to say, the attachment and removal of a latch member 47 and a crow block 45 a neighboring upper die holder 35 is done automatically by moving the upper die holder 35 holding the upper die 11 to be replaced in the longitudinal direction of the ram 13.

As can be understood from the above explanation, when a lower die 9 or an upper die 11 is loaded into the die exchange device 17 from the bending processing machine 1, the lower die 9 or the upper die 11 is divided into a number of sections which are loaded. Conversely, when a lower die 9 or an upper die 11 is unloaded from the die exchange device 17 into the bending processing machine 1, the separated sections are unloaded and then coupled together.

Figure 6:
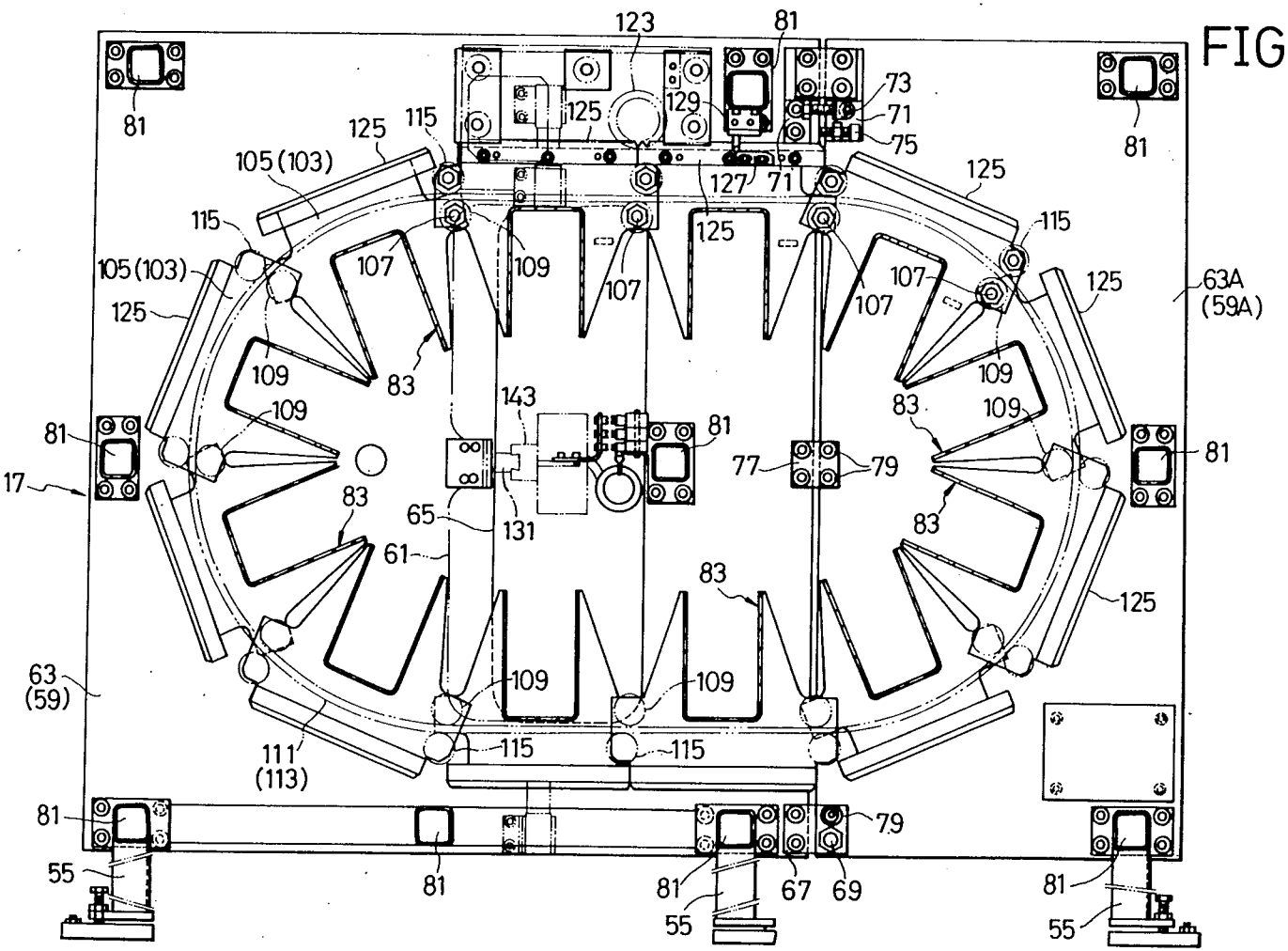
FIG. 6 is an expanded view of the cross-section VI—VI in FIG. 1.
Figure 7:
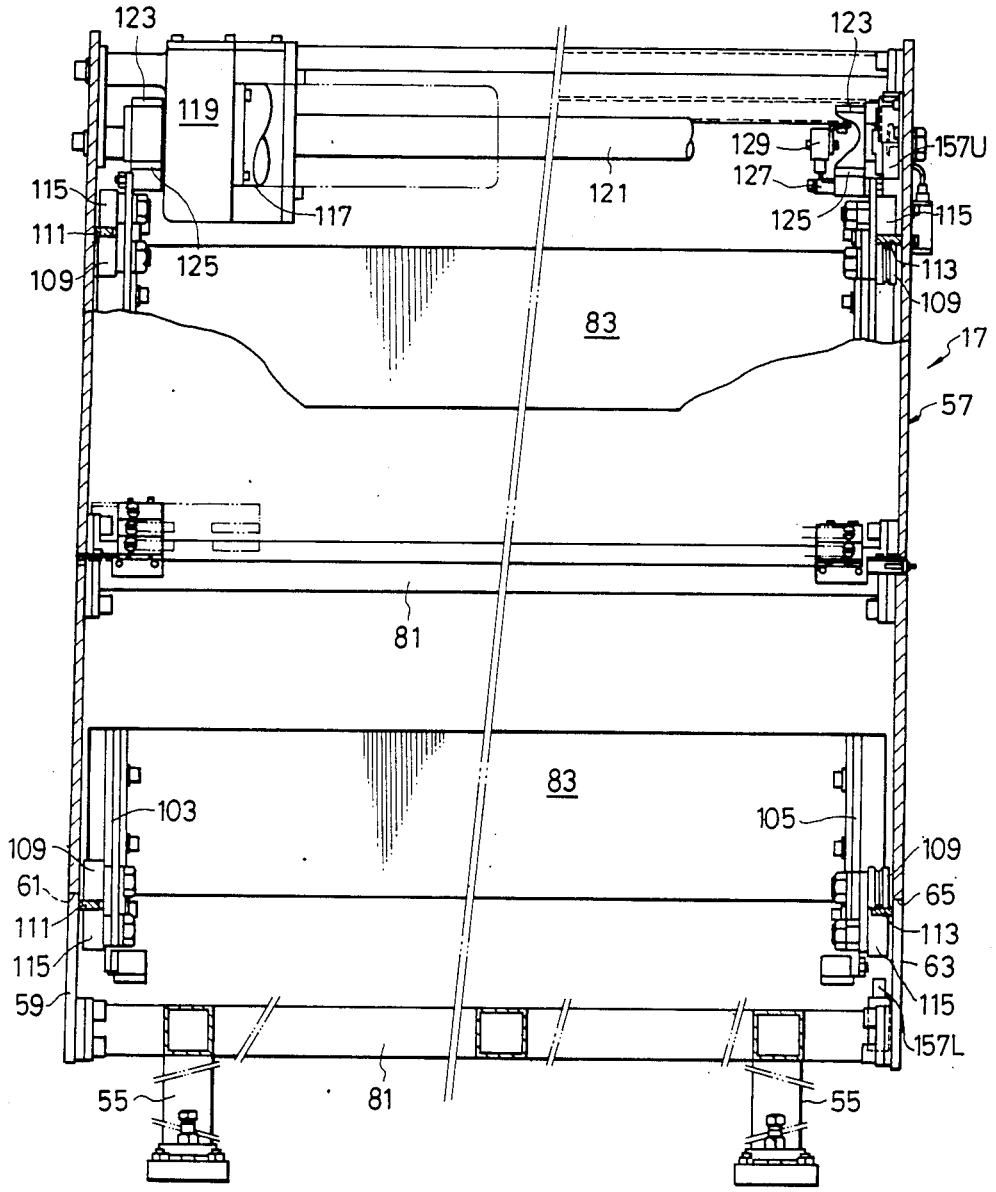
FIG. 7 is a side view of the cross-section shown in FIG. 6.

Referring to FIGS. 1, 6 and 7, the die exchange device 17, as seen from outside, consists of several support legs 55 and a box-type frame 57 which is supported by the support legs 55. The side plate 59 of the said frame 57 which faces the bending processing machine 1 has an entrance/exit opening 61 for insertion and removal of lower dies 9 and upper dies 11. The opposite side plate 63 has an observation port 65 to permit observation of the interior. Consequently, lower dies 9 and upper dies 11 can be inserted into and removed from the die exchange device 17 through the entrance/exit opening 61, and the process taking place inside can be observed through the opening 65.

Referring again to FIGS. 6 and 7, parts of the side plate 59 and the opposite side plate 63 are separated to form the adjustment side plates 59A and 63A, respectively. The adjustment side plate 63A can be moved slightly toward or away from the side plate 63 for adjustment. The bottom of the adjustment side plate 63A is pivotably attached to a bracket 67, which is fixed to the bottom of the side plate 63, through an axle 69.

L-shaped brackets 71, which face each other, are mounted near the tops of the side plate 63 and the adjustment side plate 63A, respectively. A pulling bolt 73 and the pushing bolt 75 are installed in the brackets 71 to adjust the distance of the side adjustment plate 63A from the side plate 63. Also, mounting hardware 79, including bolts, nuts, extending through long holes in the adjustment plate 63A, are installed in bracket 77, which is fixed to the side plate 63 in a suitable number of locations, and the bracket 67. Consequently, after the adjustment side plate 63A is moved slightly toward or away from the side plate 63, the adjustment side plate 63A can be fixed to the side plate 63.

Since the structure which couples the adjustment side plate 59A to the side plate 59 is identical to the above-mentioned structure which couples the adjustment side plate 63, an explanation of the details is omitted here. Also, the opposing said side plates 59 and 63, as well as the adjustment side plates 59A and 63A, are coupled solidly through several beam members 81. Consequently, the distances of the side adjustment plates 59A and 63A from the side plate 59 and 63 are coupled together solidly and are simultaneously. The purpose of adjusting the said adjustment side plates 59A and 63A is to adjust the tension on the endless die support device to be described below.

Figure 8:
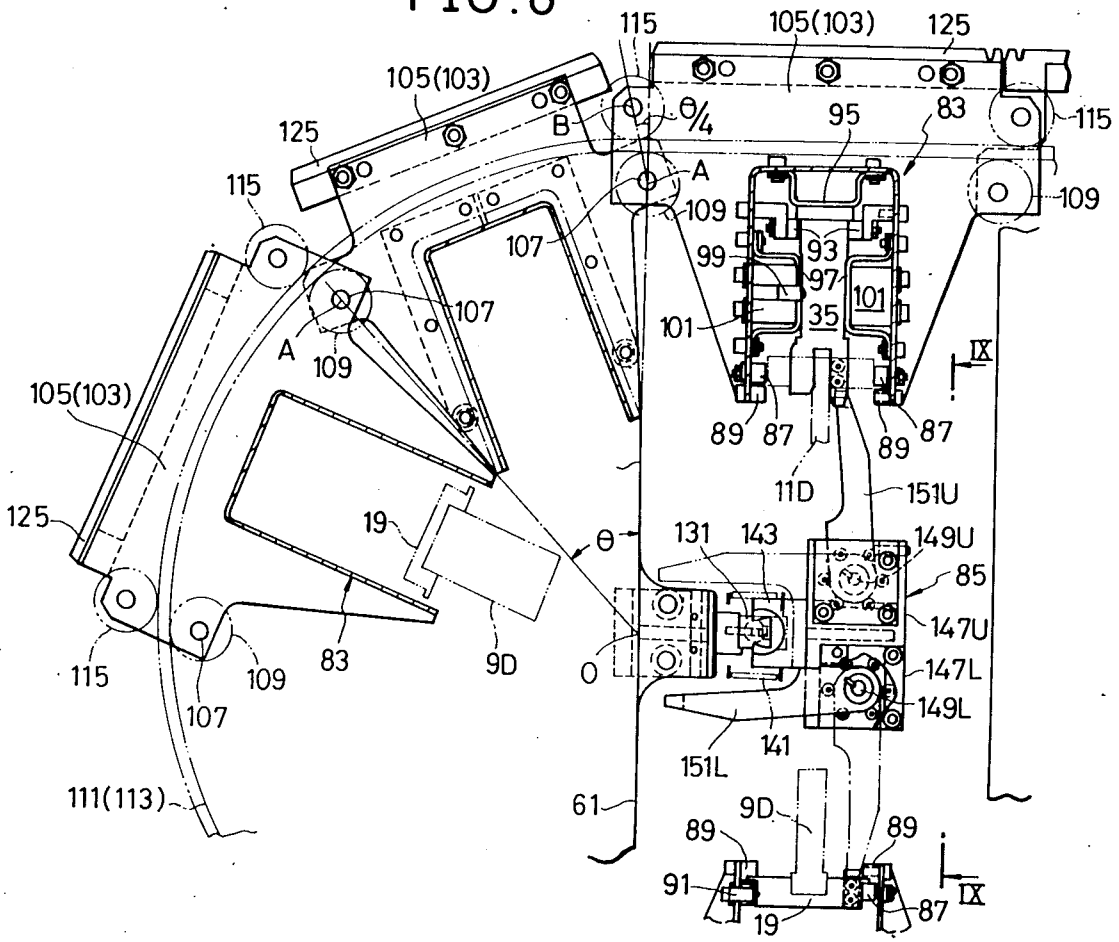
FIG. 8 is a detailed expanded view of the principal part of FIG. 6.

As is clear from FIGS. 6 to 8, inside the box-type frame 57 of the die exchange device 17 are a number of die holders 83 capable of holding the lower dies 9 and upper dies 11 along with a die insertion and removal transport device 85 which pushes and pulls the lower dies 9 and the upper dies 11 in the die holders 83 in order to insert and remove them.

As is shown best in FIG. 8, the holders 83 consist of channel members the ends of which extend until they contact the inside surfaces of the said side plates 59 and 63. A number of lower die holder support rollers 87 for the purpose of supporting the lower die holders 19 which hold the lower die sections 9D are mounted opposite each other so that they are free to roll on the inside surfaces of the die holders 83 near their entrances. There are also a number of suppression members 89 which suppress flanges on the front and rear sides of the lower die holders 19 so that the lower die holders 19 will not separate from the lower die holder support rollers 87. In addition, at suitable locations near the entrances, ball plungers 91 are mounted to hold the lower die holders 19 so that they will not come off easily when, for example, there are vibrations.

In addition, a number of upper die holder support rollers 93 are mounted opposite each other, so that they are free to roll, near the bottoms of the die holders 83 to hold the upper die holders 35 which hold the upper die sections 11D. Also on the bottoms, suppression members 95 are mounted to suppress the upper die holders 35 so that they will not separate from the upper die holder support rollers 93. Also, a number of vibration suppression members 97 are mounted opposite each other on the inside surfaces of the die holders 83 to prevent the upper die holders 35 from vibrating; while a number of holder blocks 101 having ball plungers 99 are mounted at suitable locations so that the upper die holders 35 will not be easily displaced by vibrations.

As can be understood from the above description of the configuration, the die holders 83 can hold either lower die sections 9D or upper die sections 11D.

As is shown in FIGS. 6 to 8, the two ends of the die holders 83 are supported solidly by link members 103 and 105, respectively, and the many link members 103 and 105 are respectively pivotally linked in endless loops through the hinge pins 107. An inside roller 109 is attached to each hinge pin 107 so that it is free to roll. Each inside roller 109 is in contact with the inner circumferences of the guide rails 111 and 113 which are linked endlessly from inside surface of the said side plate 59 to the inside surface of the adjustment plate 59A and from the inside surface of the side plate 63 to the inside surface of the adjustment side plate 63A. In addition, every other one of the link members 103 and 105 has outside rollers 115 mounted on it, free to roll, opposite the inside rollers 109 and in contact with the outer circumferences of the guide rails 111 and 113. Consequently, the die holders 83 which are supported to the ends of the link members 103 and 105 can roll along the guide rails 111 and 113.

As is clear from FIGS. 6 and 8, the die holders 83 are located on the inside of the guide rails 111 and 113. Consequently, when the lower die sections 9D or the upper die sections 11D are inside the die holders 83, their centers of gravity are inside the guide rails 111 and 113. Consequently, when they move from the straight line sections of the guide rails 111 and 113 to the circular arc sections of the guide rails 111 and 113, the inertia in the tangential direction is smaller than when they are on the outside of the guide rails 111 and 113. This means that the motor which drives the die holders 83 around the guide rails 111 and 113 can be small and the necessary indexing of the die holders 83 is done easily.

The inside rollers 109 are separated by such a distance that they contact the circular arc section of the guide rails 111 and 113 dividing it into equal portions. The distance between the inner roller 109 axles is less than the distance between the outer roller 115 axles. That is to say, letting "O" be the center of the circular arc section of the guide rails 111 and 113, "A" the centers of the axles of the inner rollers at the two ends of the link members 103 and 105, and "O" the angle subtended by the imaginary lines "OA", then the angles between the imaginary lines "AB" connecting the centers A of the inner roler 109 axles, and the said imaginary lines "OA" is approximately $\theta/4$. Consequently, regardless of whether the link members 103 and 105 are on the straight line section or the circular arc section of the guide rails 111 and 113, a large gap does not occur between the guide rollers 111 and 113 and the inner rollers 109 and 115, and the link members 103 and 105 move smoothly along the guide rails 111 and 113.

A drive motor 117 is installed in the frame 57 of the die exchange device 17 to drive the link members 103 and 105 along the guide rails 111 and 113. As shown in FIG. 7, the drive motor 117 is installed on the insides of the side plates 59 and 63. The two ends of the rotating shaft 121, which is coupled to the drive motor 117 through a decelerator 119 which is connected to the drive motor 117, are mounted to the side plates 59 and 63 so that they are free to rotate. The pinions 123 are installed near the two ends of this rotating shaft 121. Each pinion 123 is meshed with a rack 125 which is attached to the link members 103 and 105. Consequently, the drive motor 117, by driving the pinions 123, drives the link members 103 and 105 along the guide rails 111 and 113 through the racks 125.

In order to make the indexing of the die holders 83, which are supported by the link members 103 and 105, easy, the number of teeth on the pinions 123 is equal to the number of teeth on the racks 125. Consequently, every time the pinion 123 rotates once, the link members 103 and 105 advance by one rack 125 length. A dog 127 is mounted on each rack 125. At suitable positions in the frame 57 are limit switches 129 to detect the dogs 127. Consequently, the indexing of the die holders 83 can be detected by the action of the dogs 127 and the limit switches 129.

Referring to FIGS. 6 and 8, the die insertion and removal transport device 85 is located inside the guide rails 111 and 113. The die insertion and removal transport device 85 transports the lower die section 9D or the upper die section 11D in the die holder 83 at a position corresponding to the entrance/exit opening 61 on the frame 57 of the die exchange device 17 into the bending processing machine 1, or alternatively it transports a lower die section 9D or an upper die section 11D from the bending processing machine 1 into the corresponding die 83.

Figure 9:
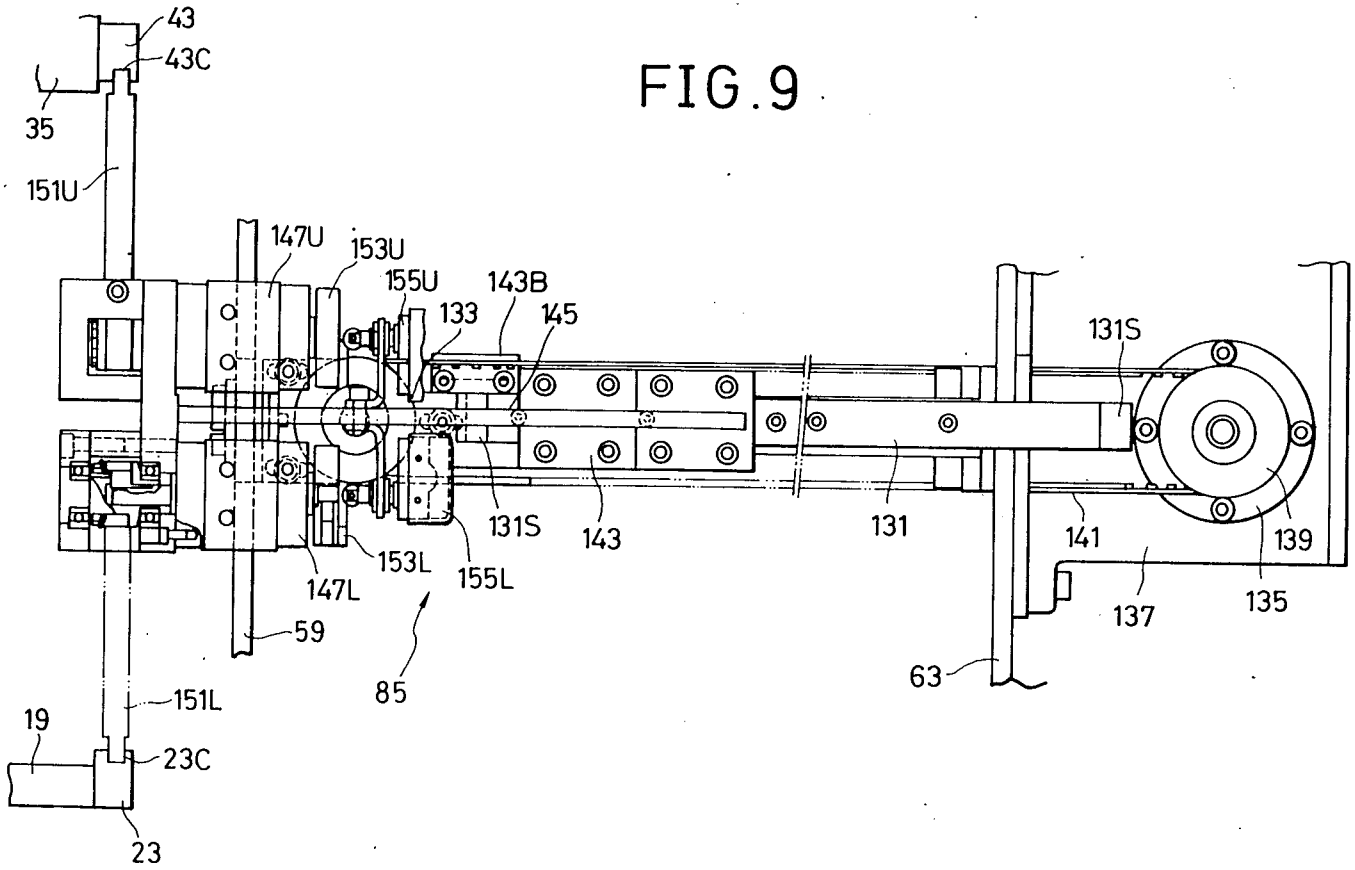
FIG. 9 is a perspective view along cross-section IX—IX in FIG. 8.

In more detail, as shown in FIGS. 8 and 9, the straight guide bar 131, which has stoppers 131S at both ends, is installed horizontally between the side plates 59 and 63. A pulley 133 such as a timing pulley is installed near the end of this guide bar 131 that is installed in the side plate 59, while an insertion and removal transport motor 135, is supported on the other side plate 63 through the bracket 137.

The drive pulley 139 is attached to the output shaft of the insertion and removal transport motor 135. An endless belt 141 such as a timing belt is installed on this drive pulley 139 and the pulley 133. The guide bar 131 is located inside the area in which the endless belt 141 is trained. A slider 143, which is supported on the guide bar 131 so that it is free to slide, is coupled to an endless belt 141 at a suitable position through the bracket 143B which is solidly attached to the slider 143. Consequently, when the insertion and removal transport motor 135 drives the drive pulley 139 in forward or reverse at a suitable speed, the slider 143 reciprocates along the guide bar 131.

A support bracket 145 is solidly attached horizontally to the slider 143 so that it is free to protrude from the entrance/exit transport hole 61 in the side plate 59 toward the bending processing machine 1. Above and below this support bracket 145 are, respectively, an upper actuator 147U and a lower actuator 147L. The upper and lower actuators 147U and 147L consist respectively of suitable rotary actuators. Their rotation shafts 149U and 149L are respectively attached to the upper and lower latch levers 151U and 151L the orientations of which can be freely varied from approximately horizontal to approximately vertical.

The upper latch lever 151U can be freely attached to or removed from the upper die holder 35 which is supported to the ram 13 in the bending processing machine 1, or alternatively to the concave section 43C of the hook lock 43 in the upper die holder 35 which is in the die holder 83 that has been indexed with respect to the upward direction. When it is vertical it is attached to the concave section 43C.

The lower latch lever 151L can be freely attached to or removed from the lower die holder 19 which is supported on the lower frame 7 of the bending processing machine 1, or alternatively to the concave section 23C of the hook lock 23 in the lower die holder 19 which is in the die holder 83 that is indexed with respect to the downward direction. When it is vertical it is attached to the concave section 23C.

As can be understood from the above description of the configuration, after the upper and lower actuators 147U and 147L have been operated simultaneously or separately, and the upper and lower latch levers 151U and 151L have been simultaneously or separately hooked on the upper die holder 35 and the lower die holder 19, operation of the insertion and removal transport motor 135 causes the drive pulley 139 to turn and the slider 143 to move, transporting a lower die 9 and upper die 11 into or out of the die exchange device 17 either simultaneously or separately.

Cam members 153U and 153L are attached to rotating shafts 149U and 149L of the upper and lower actuators 147U and 147L respectively. In addition, upper and lower limit switches 155U and 155L corresponding to the cam members 153U and 153L are mounted on the support bracket 145. Consequently, whether the latch levers 151U and 151L are horizontal or vertical can be detected.

When, as described above, upper and lower holders 35 and 19 are transported into or out of the die holders 83 in the die exchange device 17 by the die insertion and removal transport device 85, there is a means to detect whether or not the holders 35 and 19 are inside the die holder 83 that has been indexed to the position corresponding to said upper and lower actuators 147U and 147L. That is to say, as shown in FIGS. 6 and 7, sensors 157U and 157L are installed on either the side plate 59 or the side plate 63 to detect the upper and lower holders 35 and 19 in the die holder 83 that has been indexed to the position corresponding to the entrance/exit opening 61 by optical or other means.

As is understood from the above explanation, to, for example, transport a lower die 9 or an upper die 11 into each die holder 83 in the die exchange device 17 from the bending processing machine 1, the slider 143 in the die insertion and removal transport device 85 is moved to the side nearest to the bending processing machine 1, and the upper and lower latch levers 151U and 151L are simultaneously or separately hooked on the hook blocks 43 and 23 on the upper and lower holders 35 and 19. Then the slider 143 is retracted to insert the upper and lower holders 35 and 19 into the die holder 83 simultaneously or separately. At the time, when the latch members 47 and 27 in the upper and lower holders 35 and 19 advance to the positions of the release rollers 53 and 31 in the bending processing machine, respectively, the upper and lower holders 35 and 19 are respectively separated from the neighboring parts. Consequently, after the separated parts of the upper and lower holders are inserted into the die holder 83, another empty die holder 83 is indexed and the action described above is repeated. By repeating this action a number of times, a number of separated sections of the upper die 11 and the lower die 9 can be inserted into the die holders 83. Also, by carrying out the reverse of the action described above, upper dies and lower dies separated from the die holders 83 in the die exchange device 17 can be loaded into the bending processing machine, upper and lower dies together or separately, one after another.

As can be understood from the explanation of an embodiment given above, this invention can be summarized as follows. A number of link members are pivotally linked in an endless loop so that they are free to circulate around a guide rail loop part of which is a circular arc. Near both ends of a suitable number of link members are a number of inner rollers in contact with the inner circumference of the guide rails and outer rollers in contact with the outer circumference so that they are free to roll. Since the distance between the inner roller axles is less than the distance between the outer roller axles, regardless of whether the link members are on the straight line section or the circular arc section of the guide rails a large gap does not occur between the inner and outer rollers and the guide rails, and the link members move smoothly along the guide rails. In addition, since the play is small, the noise and vibrations produced are very small.

This invention is not limited to the embodiment described above. By making appropriate changes in the details, it can also be applied in other embodiments.

What is claimed is:

1. A die exchange device comprising:

a frame having first and second side plates disposed in said frame, each of said side plates having an inside surface;

a first annular guide rail mounted on the inside surface of said first side plate;

a second annular guide rail mounted on the inside surface of said second side plates and spaced a distance apart from first annular guide rail;

a first number of link members supported on said first annular guide rail and pivotally linked to one another to form a ring along said first annular guide rail, said first number of link members having an inner side with respect to said first annular guide rail;

a second number of link members supported on said second annular guide rail and pivotally linked to one another to form a ring along said second annular guide rail, said second number of link members having an inner side with respect to said second annular guide rail;

a rack attached to each of said first and second number of link members;

a first pinion member supported on said first side plate adapted to engage said racks on said first number of link members;

a second pinion member supported on said second side plate adapted to engage said racks on said second number of link members;

means supported on said frame for rotating said first and second pinion members to drive said first and second link members around said first and second guide rails, respectively; and a number of die holders, each having a length substantially equal to the distance between said first and second annular guide rails, each of said die holders being mounted on the inner side of one of said first link members with respect to said first annular guide rail and on the inner side of one of said second link members with respect to said second annular guide rail.

2. The die exchange device of claim 1 for the exchange of upper and lower die sections comprising;

a die insertion and removal transport device operatively associated with said frame and positioned for selective engagement with and transport of each of the upper and lower die sections;

a transferring member operatively located in the die insertion and removal transport device having an upper latch member to which latch portions of an upper die section can be attached and removed, and a lower latch member to which latch portions of a lower die section can be attached and removed, wherein said upper latch member and lower latch member are adapted to operate independently of one another.

3. A die exchange device as described in claim 2 wherein, the said transferring member is coupled to the inside of an endless belt means operatively supported and associated with said die insertion and removal transport device and axially positioned in alignment with the direction of transport of said die sections, and further comprising means operatively associated with said die insertion and removal transport device for driving said belt whereby said transferring member can be driven for selective engagement with and transport of said die sections.

4. The die exchange device of claim 2 further comprising:

means for adjusting said side plates relative to one another on the frame, whereby the tension on said rings can be adjusted.

5. The die exchanging device of claim 1 wherein, said first and second guide rails or at least part of which are in the shape of a circular arc, said guide rails being disposed in a vertical plane, and said guide rails having inner and outer surfaces;

said link members further having two ends;

a suitable number of the link members having inner rollers which contact the inner guide rail surface and outer rollers which contact the outer guide rail surface mounted at the two ends of said link members so that they are free to roll, said inner and outer rollers being mounted on said link members by axles, such that the distance between the axles of the inner rollers is less than the distance between the axles of the outer rollers.

6. An endless support device comprising:

a ring-shaped guide rail at least part of which is in the shape of a circular arc, said arc being disposed in a vertical plane, and said guide rail having inner and outer surfaces;

a number of link members mutually pivotably linked in a loop so that they are free to slide along the the said guide rail;

a suitable number of the link members having inside rollers which contact the inner guide rail surface and outer rollers which contact the outer guide rail surface mounted at their two ends so that they are free to roll, such that the distance between the axles of the inner rollers is less than the distance between the axles of the outer rollers;

wherein, if $\theta$ is the angle subtended by imaginary lines extending between the center of the circular arc section of the guide rail through the center of two adjacent inner rollers, the acute angle subtended by one of said imaginary lines and a third imaginary line joining the center of the inner roller through which said one of said imaginary lines passes and the center of the outer roller which is closest to the inner roller through which said one of said imaginary lines passes, is about $\theta/4$.

* * * * *